US005105695A

United States Patent [19]

Borvitz

[11] Patent Number: 5,105,695

[45] Date of Patent: Apr. 21, 1992

[54] SLICE-CUTTING MACHINE

[75] Inventor: Wolfgang Borvitz, Braunschweig, Fed. Rep. of Germany

[73] Assignee: Herbort Maschinenfabrik GmbH, Braunschweig, Fed. Rep. of Germany

[21] Appl. No.: 614,141

[22] Filed: Nov. 16, 1990

[30] Foreign Application Priority Data

Nov. 17, 1989 [DE] Fed. Rep. of Germany ... 8913582[U]

[51] Int. Cl.[5] ..... B26D 7/06

[52] U.S. Cl. ..... 83/13; 83/410.007; 83/439; 83/443; 83/717; 83/733

[58] Field of Search ..... 83/440, 441, 443, 717, 83/468.7, 268, 733, 410.7, 13, 42, 39, 439

[56] References Cited

U.S. PATENT DOCUMENTS 1,589,030 6/1926 Whiting ..... 83/468.7 X

FOREIGN PATENT DOCUMENTS 651279 9/1937 Fed. Rep. of Germany ..... 83/717

*Primary Examiner*—Douglas D. Watts
*Assistant Examiner*—Kenneth E. Peterson
*Attorney, Agent, or Firm*—Foley & Lardner

[57] ABSTRACT

A slice-cutting machine, for cutting slices out of tuberous vegetables or root crops, has a rotor mounted rotatably in a rotation housing, which rotor carries along the material to be cut in the direction of rotation and at the same time presses it against the inner wall of the rotation housing. A flap is formed over a section of the circumference of the rotor. The flap is pivotably mounted at its front end and with respect to the direction of rotation of the rotor. In the opening position with its back end opposite a permanently arranged blade, the flap limits a cutting gap defining the thickness of the cut. A resilient device is provided which pivots the flap into a widening opening position, and a manually rotatable eccentric, which acts upon the flap contrary to the effect of the resilient device, is provided to alter the cutting gap.

17 Claims, 2 Drawing Sheets

SLICE-CUTTING MACHINE

BACKGROUND OF THE INVENTION

The invention relates to a slice-cutting machine. In particular, the invention relates to a machine for cutting slices from tuberous vegetables or root crops. The machine has a rotor which is rotatably mounted within a rotation housing, which rotor carries along the material to be cut in the direction of rotation and at the same time presses it against the inner wall of the rotation housing. The housing is formed over a section of the circumference by a flap which is pivotably mounted at its front end with respect to the direction of rotation of the rotor and, in the opening position with its back end positioned opposite a permanently arranged blade, limits a cutting gap defining the thickness of cut. An adjusting device which pivots the flap is provided to alter the cutting gap.

The material to be cut is fed via the opened flap to the blade, preferably a flat blade, with the result that the thickness of the cut is determined by the opening width of the flap. It is known in the prior art to adjust the flap via a threaded spindle and several levers. What is disadvantageous in this arrangement is the large number of components and also the unavoidable play in the thread and the support points of the levers.

SUMMARY OF THE INVENTION

The invention is therefore based on the object of developing an improved embodiment for the adjustment of the flap.

In accordance with a first aspect of the invention, the machine comprises a rotation housing, a rotor which is rotatably mounted within the rotation housing and which is adapted to carry along the material to be cut and to press the material against an inner surface of the rotation housing, a cutting blade fixedly attached to the housing, and a flap formed over a section of a circumferential surface of the rotor. A front end of the flap is pivotally mounted to the housing, and a back end of the flap is spaced from the blade, which space forms a cutting gap defining a thickness of a cut. A resilient device is attached to the flap and is adapted to bias the back end of the flap away from the blade. In addition, a manually rotatable eccentric imposes a force on the flap which opposes the force imposed by the resilient device.

In accordance with another aspect of the invention, the machine further includes a graduated ring which is disposed on a peripheral surface of the eccentric. The eccentric and the graduated ring are rotatable with respect to one another, and a device is provided for detachably fixing the eccentric and the graduated ring to one another at a desired location.

In accordance with yet another aspect of the invention, the machine further includes a friction element which abuts the eccentric and which is adapted to counteract rotation of the eccentric.

Another object of the invention is to provide a method for cutting slices from materials.

In accordance with one aspect of the invention, the method includes the steps of providing a rotation housing and rotating a rotor mounted within the rotation housing through a first angle of rotation to carry along the material to be cut while pressing the material against an inner surface of the rotation housing. A subsequent step includes rotating the rotor through a second angle of rotation to carry the material past an inner surface of a flap formed over a section of a circumferential surface of the rotor, the flap having a front end which is pivotally mounted to the housing and having a back end which is spaced from a blade, which space forms a cutting gap. Another step includes rotating the rotor through a third angle of rotation to carry the material past the blade in contact therewith so that the blade cuts a slice having a thickness corresponding to the thickness of the cutting gap. Additional steps include biasing the back end of the flap away from the blade, and adjusting a thickness of the cutting gap by imposing an adjustable force on an outer surface of the flap, which adjustable force opposes the biasing force imposed on the back end of the flap.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

An embodiment of the invention which serves as an example is shown in the drawings, in which.

DETAILED DESCRIPTION OF THE PREFERRED EMBODIMENTS

Figure 1:
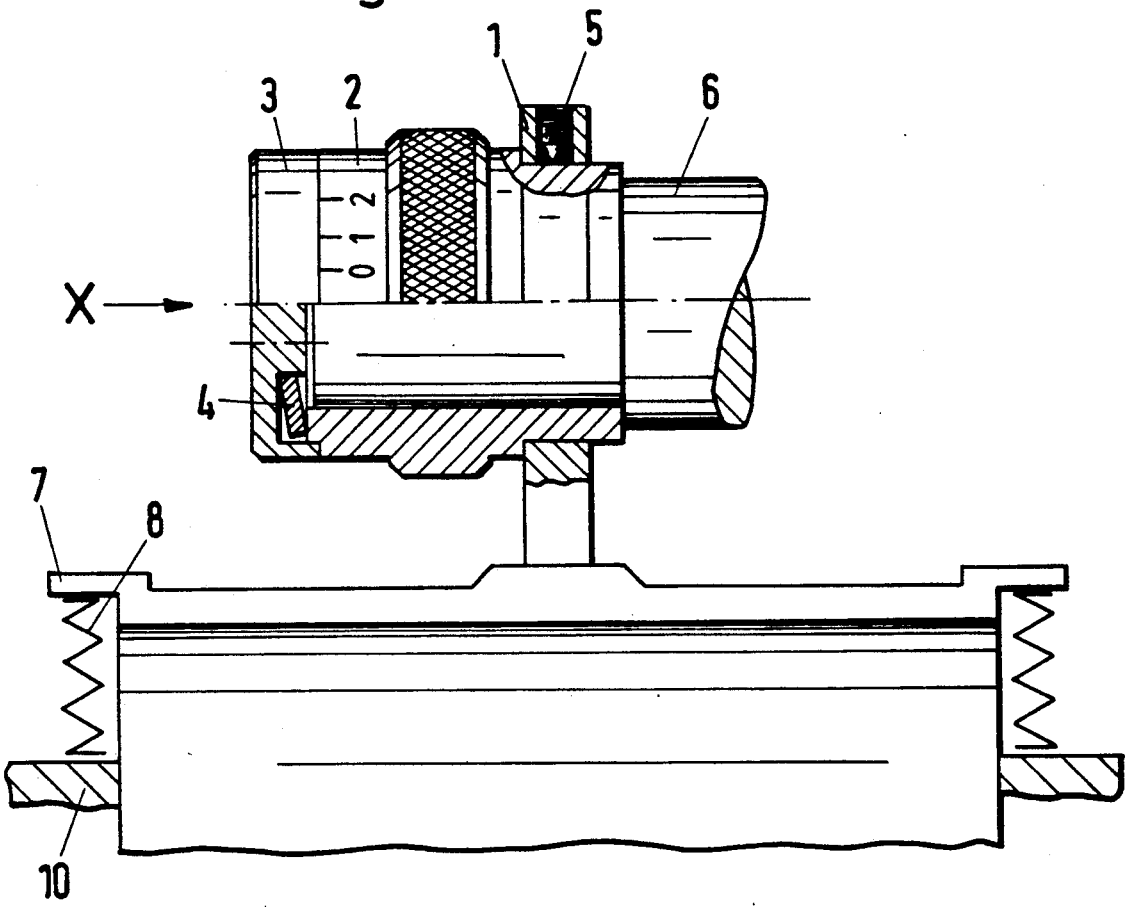
FIG. 1 shows a side view of a cutout of a slice-cutting machine constructed in accordance with the present invention.
Figure 2:
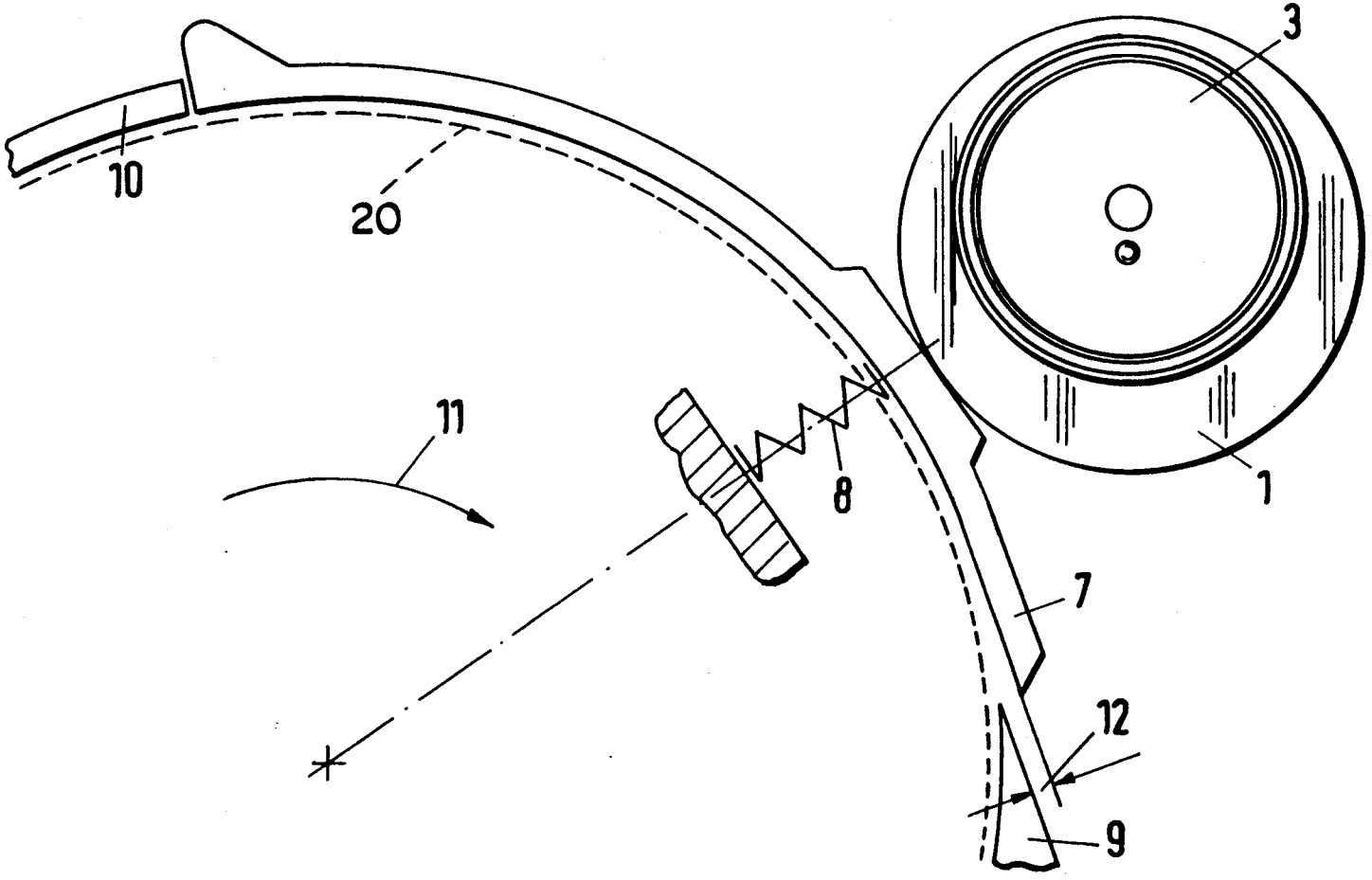
FIG. 2 shows a view in the direction of the arrow X in FIG. 1.

According to the invention, a resilient device pivots the flap into a widening opening position, and a manually rotatable eccentric acts upon the flap contrary to the effect of the resilient device.

In order to achieve precise adjustment, it is expedient for a graduated ring to be assigned to the eccentric. For setting the zero point it is advantageous if the eccentric and the graduated ring are rotatable with respect to one another and if they can be fixed with respect to each other in the desired position.

In order to avoid undesired displacement of the eccentric, for example as a result of vibration of the machine, a friction element which counteracts a rotation of the eccentric may be provided.

A solution of particularly simple design is provided if the resilient device consists of at least one compression spring which is arranged outside of the interior of the housing and which acts radially upon the flap towards the outside, i.e., outwardly in the radial direction.

The Figures reveal a short section of a rotation housing 10 of a slice-cutting machine, in which section a rotor 20 is rotatably mounted, the direction of rotation of which is marked by the arrow 11. While rotating, the rotor carries along the material to be cut and concurrently presses it against the inner wall of the housing. A section of the circumference of the rotation housing 10 is formed by a flap 7, which continues the inner wall of the rotation housing 10 without interruption in the direction of rotation 11. Flap 7 is pivotably mounted to the housing at its front end with respect to the direction of rotation 11 of the rotor. Moreover, in the opening position with its back end disposed opposite a permanently arranged flat blade 9, flap 7 limits a cutting gap 12 defining the thickness of the cut.

There is further provided a resilient device 8 which pivots the flap 7 into a widening opening position and which, in the exemplary embodiment shown, consists of two compression springs arranged outside the interior of the housing. The springs press the flap 7 radially towards the outside, i.e., outwardly in the radial direction.

In order to alter the cutting gap 12, a manually rotatable eccentric 1, located on an axle 6, is provided. Eccentric 1 acts upon the flap 7 on the side opposite the resilient device 8, i.e., from the outside, contrary to the effect of the resilient device 8. A graduated ring 2 is assigned to the eccentric 1 and extends cirumferentially around the peripheral surface of the eccentric. In order to set the zero point, i.e., to calibrate the graduated ring, the eccentric 1 may be adjusted by releasing a set screw 5 which normally fixes the eccentric with respect to the graduated ring 2 and which, when released, allows the graduated ring 2 to rotate with respect to the eccentric 1. Once the zero point has been set, the eccentric 1 is again fixed on the graduated ring 2 by tightening the set screw 5, and the eccentric 1 is thus fixed with respect to the graduated ring 2.

The axle 6 is covered at the end face by an axle cover 3, into which a friction element 4 is inserted, which friction element may be a cup spring or an elastomer. Friction element 4 rests in a frictional manner against the end face of the axle 6, in order thus to prevent an unintentional displacement of the eccentric 1.

What is claimed is:

1. A machine for cutting slices from materials, comprising (A) a rotation housing;

(B) a rotor which is rotatably mounted within said rotation housing and which is adapted to carry along the material to be cut and to press said material against an inner surface of said rotation housing;

(C) a cutting blade fixedly attached to said housing;

(D) a flap formed over a section of a circumferential surface of said rotor, said flap having a front end which is pivotally mounted to said housing and having a back end which is spaced from said blade, which space forms a cutting gap defining a thickness of a cut;

(E) a resilient device which is attached to said flap and which is adapted to bias said back end of said flap away from said blade; and (F) a manually rotatable eccentric which imposes a force on said flap which opposes the force imposed by said resilient device.

2. A slice-cutting machine as claimed in claim 1, further comprising a graduated ring disposed on a peripheral surface of said eccentric.

3. A slice-cutting machine as claimed in claim 1, further comprising a friction element which abuts said eccentric and which is adapted to counteract rotation of said eccentric.

4. A slice-cutting device as claimed in claim 1, wherein said resilient device comprises at least one compression spring which is disposed outside of said housing and which acts radially upon said flap towards an outside of said housing.

5. A machine for cutting slices from materials, comprising (A) a rotation housing;

(B) a rotor which is rotatably mounted within said rotation housing and which is adapted to carry along the material to be cut and to press said material against an inner surface of said rotation housing;

(C) a cutting blade fixedly attached to said housing;

(D) a flap formed over a section of a circumferential surface of said rotor, said flap having a front end which is pivotally mounted to said housing and having a back end which is spaced from said blade, which space forms a cutting gap defining a thickness of a cut;

(E) a resilient device which is attached to said flap and which is adapted to bias said back end of said flap away from said blade;

(F) a manually rotatable eccentric which imposes a force on said flap which opposes the force imposed by said resilient device;

(G) a graduated ring disposed on a peripheral surface of said eccentric, said eccentric and said graduated ring being rotatable with respect to one another; and (H) means for detachably fixing said eccentric and said graduated ring to one another at a desired location.

6. A slice-cutting machine as claimed in claim 5, wherein said means for detachably fixing comprises a set screw.

7. A machine for cutting slices from materials, comprising (A) a rotation housing;

(B) a rotor means, rotatably mounted within said rotation housing, for carrying along the material to be cut and for pressing said material against an inner surface of said rotation housing;

(C) blade means, fixed to said housing, for cutting slices from said materials;

(D) a flap formed over a section of a circumferential surface of said rotor, said flap having a front end which is pivotally mounted to said housing and having a back end which is spaced from said blade means, which space forms a cutting gap defining a thickness of a cut;

(E) resilient means, attached to said flap, for biasing said back end of said flap away from said blade means; and (F) means for adjusting a thickness of said cutting gap by imposing an adjustable force on said flap, which force opposes the force imposed by said resilient device.

8. A slice-cutting machine as claimed in claim 7, wherein said means for adjusting comprises a manually rotatable eccentric which abuts said flap.

9. A slice-cutting machine as claimed in claim 8, further comprising a graduated ring disposed on a peripheral surface of said eccentric.

10. A slice-cutting machine as claimed in claim 7, further comprising a friction element which abuts said eccentric and which is adapted to counteract rotation of said eccentric.

11. A slice-cutting device as claimed in claim 7, wherein said resilient means comprises at least one compression spring which is disposed outside of said housing and which acts radially upon said flap towards an outside of said housing.

12. A machine for cutting slices from materials, comprising (A) a rotation housing;

(B) a rotor means, rotatably mounted within said rotation housing, for carrying along the material to be cut and for pressing said material against an inner surface of said rotation housing;

(C) blade means, fixed to said housing, for cutting slices from said materials;

(D) a flap formed over a section of a circumferential surface of said rotor, said flap having a front end which is pivotally mounted to said housing and having a back end which is spaced from said blade means, which space forms a cutting gap defining a thickness of a cut;

(E) resilient means, attached to said flap, for biasing said back end of said flap away from said blade means;

(F) means for adjusting a thickness of said cutting gap by imposing an adjustable force on said flap, which force opposes the force imposed by said resilient device;

(G) a graduated ring disposed on a peripheral surface of said eccentric, said eccentric and said graduated ring being rotatable with respect to one another; and (H) means for detachably fixing said eccentric and said graduated ring to one another at a desired location.

13. A slice-cutting machine as claimed in claim 12, wherein said means for detachable fixing comprises a set screw.

14. A method for cutting slices from materials, comprising (A) providing a rotation housing;

(B) rotating a rotor mounted within said rotation housing through a first angle of rotation to carry along the material to be cut while pressing said material against an inner surface of said rotation housing; then (C) rotating said rotor through a second angle of rotation to carry said material past in inner surface of a flap formed over a section of a circumferential surface of said rotor, said flap having a front end which is pivotally mounted to said housing and having a back end which is spaced from a blade, which space forms a cutting gap; and then (D) rotating said rotor through a third angle of rotation to carry said material past said blade in contact therewith so that said blade cuts a slice having a thickness corresponding to a thickness of said cutting gap;

(E) biasing said back end of said flap away from said blade; and (F) adjusting a thickness of said cutting gap by adjusting a force which is imposed on an outer surface of said flap, which force opposes the biasing force imposed on said back end of said flap.

15. A method as claimed in claim 14, wherein said step (F) comprises the step of rotating an eccentric which abuts said outer surface of said flap.

16. A method for cutting slices from materials, comprising (A) providing a rotation housing;

(B) rotating a rotor mounted within said rotation housing through a first angle of rotation to carry along the material to be cut while pressing said material against an inner surface of said rotation housing; then (C) rotating said rotor through a second angle of rotation to carry said material past in inner surface of a flap formed over a section of a circumferential surface of said rotor, said flap having a front end which is pivotally mounted to said housing and having a back end which is spaced from a blade, which space forms a cutting gap; and then (D) rotating said rotor through a third angle of rotation to carry said material past said blade in contact therewith so that said blade cuts a slice having a thickness corresponding to the thickness of said cutting gap;

(E) biasing said back end of said flap away from said blade; and (F) adjusting a thickness of said cutting gap by rotating an eccentric which abuts said outer surface of said flap, thereby adjusting a force which is imposed on another surface of said flap, which force opposes the biasing force imposed on said back end of said flap; and wherein said rotating step comprises said eccentric with respect to a graduated ring disposed on said eccentric in order to calibrate said graduated ring.

17. A method as claimed in claim 16, further comprising the steps of loosening a set screw, which fixes said graduated ring to said eccentric, prior to calibrating said graduated ring, and tightening said set screw after calibrating said graduated ring.

* * * * *